US007819544B2

(12) United States Patent
Thompson et al.

(10) Patent No.: US 7,819,544 B2
(45) Date of Patent: Oct. 26, 2010

(54) PRESSURE ACTIVATED LIGHTED GLOVE

(76) Inventors: Justin Thompson, 112 Mound Rd., Duncan Falls, OH (US) 43734; Timothy L. Matheney, II, 9845 Bush Hill Rd., Blue Rock, OH (US) 43720

( * ) Notice: Subject to any disclaimer, the term of this patent is extended or adjusted under 35 U.S.C. 154(b) by 0 days.

(21) Appl. No.: 12/360,580

(22) Filed: Jan. 27, 2009

(65) Prior Publication Data

US 2009/0323316 A1 Dec. 31, 2009

Related U.S. Application Data

(60) Provisional application No. 61/133,082, filed on Jun. 26, 2008.

(51) Int. Cl.
*F21V 33/00* (2006.01)

(52) U.S. Cl. ..... 362/103

(58) Field of Classification Search ..... 362/103
See application file for complete search history.

(56) References Cited

U.S. PATENT DOCUMENTS

| | | | | |
|---|---|---|---|---|
| 3,961,175 | A | 6/1976 | Otagoshi | |
| 3,971,028 | A | 7/1976 | Funk | |
| 4,215,389 | A | 7/1980 | Colangelo | |
| 4,304,825 | A | 12/1981 | Basau | |
| 4,355,309 | A | 10/1982 | Hughey et al. | |
| 4,398,237 | A | 8/1983 | Doyel | |
| 4,422,131 | A | 12/1983 | Clanton et al. | |
| 4,625,339 | A | 12/1986 | Peters | |
| 4,873,160 | A | 10/1989 | Miyazaki et al. | |
| 4,977,489 | A | 12/1990 | Fung | |
| 4,996,128 | A | 2/1991 | Aldecoa et al. | |
| 5,041,825 | A | 8/1991 | Hart et al. | |
| 5,124,892 | A | 6/1992 | Lambert | |
| 5,154,506 | A | 10/1992 | Leard | |
| 5,177,467 | A * | 1/1993 | Chung-Piao | 340/574 |
| 5,192,126 | A | 3/1993 | Remeyer et al. | |
| 5,283,722 | A | 2/1994 | Koenen et al. | |
| 5,345,368 | A | 9/1994 | Huff | |
| 5,449,567 | A | 9/1995 | Yeh | |
| 5,535,105 | A | 7/1996 | Koenen et al. | |
| 5,919,589 | A | 7/1999 | Kawakami et al. | |
| 6,006,357 | A | 12/1999 | Mead | |
| D423,758 | S | 5/2000 | Jones | |
| 6,290,367 | B1 | 9/2001 | Greenhoe et al. | |
| 6,592,235 | B1 | 7/2003 | Mayo | |
| 6,892,397 | B2 | 5/2005 | Raz et al. | |
| 7,152,248 | B2 * | 12/2006 | Ziemer | 2/160 |
| 2001/0048596 | A1 * | 12/2001 | Kerr | 362/110 |
| 2005/0207196 | A1 | 9/2005 | Holmes et al. | |
| 2008/0062676 | A1 * | 3/2008 | Masuda | 362/103 |

OTHER PUBLICATIONS

Blackhawk Protective Gear, packaging insert, Revised Nov. 2007.
Cabela's ULH LED Clip Light, webpage copyrighted 1996-2008, 2 pages, retreived at http://www.cabelas.com/cabelas/en/templates/link...p.form23&_dyncharset=ISO-8859-1&_requestid=76334 on Feb. 9, 2009.

* cited by examiner

*Primary Examiner*—Laura Tso
(74) *Attorney, Agent, or Firm*—Standley Law Group LLP

(57) ABSTRACT

A lighted glove including a light source, a means for attaching the light source to the glove, a power source in electrical communication with the light source, a pressure sensor attached to the glove, and a pressure sensor bypass means.

24 Claims, 9 Drawing Sheets

PRESSURE ACTIVATED LIGHTED GLOVE

CROSS REFERENCE TO RELATED APPLICATIONS

This application claims priority to U.S. 61/133,082 filed Jun. 26, 2008.

TECHNICAL FIELD

Exemplary embodiments relate generally to a lighting device. More particularly, embodiments relate to a glove equipped with a light source that can be activated and deactivated through the application of pressure to a pressure sensor that is attached to or located within the glove.

BACKGROUND AND SUMMARY OF THE INVENTION

In certain professions and hobbies, individuals must be prepared to handle poorly lit conditions on short notice. Thus, it has become customary for many individuals to carry flashlights on a day to day or at least on a regular basis. Though advances in technology have permitted flashlights to be minimized in size, it is still often inconvenient to juggle a traditional flashlight as well as other devices that may be required by the task at hand.

Take for example the profession of law enforcement. Officers of the law must often work in the dark under dangerous conditions: a combination that has made flashlights integral to officer safety. Unfortunately, using one hand for the purpose of carrying and operating a flashlight has often times interfered with other important law enforcement tasks such as firing a gun, calling for reinforcement using a radio or telephone, setting off tear gas, operating a bike or other vehicle, etc. A device such as a lighted glove, which could permit law enforcement officials to combat poorly lit conditions without interfering in the officers' other operations would be well received by this demographic.

Lighted gloves are not new to the art. Examples of typical lighted gloves may be found in U.S. Pat. No. 7,152,248, U.S. Pat. No. 6,592,235, U.S. Pat. No. 5,345,368, U.S. Pat. No. 5,283,722, U.S. Pat. No. 5,154,506, U.S. Pat. No. 5,124,892, U.S. Pat. No. 4,625,339, U.S. Pat. No. 5,535,105, U.S. Pat. No. 6,006,357, U.S. Pat. No. 6,892,397, U.S. Pat. No. 4,422,131, and U.S. Pat. No. D423,758, all of which are hereby incorporated by reference. Among the problems with the lighted gloves existing in the art, and the most probable reason their use has not become wide spread among individuals such as police officers, is the fact that they can not be operated in a way that actually frees up hand space nor can their light sources be activated and deactivated quickly. In order to activate the light source on one of the existing lighted gloves, a user must use his non-gloved hand to find and then push the light's activation/deactivation button. This can be especially burdensome if both of the officer's hands are in gloves; bulky glove fabric makes manually turning a light on and off more difficult.

The currently disclosed pressure-activated lighted glove solves many of the problems that have plagued preexisting lighted gloves. In one exemplary embodiment, the lighted glove is activated and deactivated by applying pressure to the palm of the glove. In this exemplary embodiment, the applied pressure can be detected by a pressure sensor that has been inserted in the glove's palm. The sensor, can convert the detected pressure into a signal which is then sent to a power source for the glove's light source. Upon receiving the signal, the power source can cause the light source to be turned on or off. In some exemplary embodiments, there is one light source per glove. In other exemplary embodiments, there is more than one light source per glove. In a preferred exemplary embodiment, a pressure activated lighted glove has one light source that is located on the back side of the user's hand while the user is wearing the glove. A light source of the presently disclosed lighted glove may be an LED, but many light sources can be used in practicing the invention.

Another exemplary embodiment of a pressure activated lighted glove comprises a three way switch that works in conjunction with a pressure sensor. In a preferred embodiment, the three way switch has the following three settings: pressure activation, light on, and light off. When the switch is set to "pressure activation", the pressure sensor can be used to turn the glove's light on and off. When the switch is set to "light on" the glove's light is activated independently of the pressure-activation pad. When the switch is set to "light off" the glove's light is deactivated and the only way to turn it on is to turn the switch to one of its other two settings. In some exemplary embodiments the pressure activated glove has a switch with more or less than three settings.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION

Figure 1:
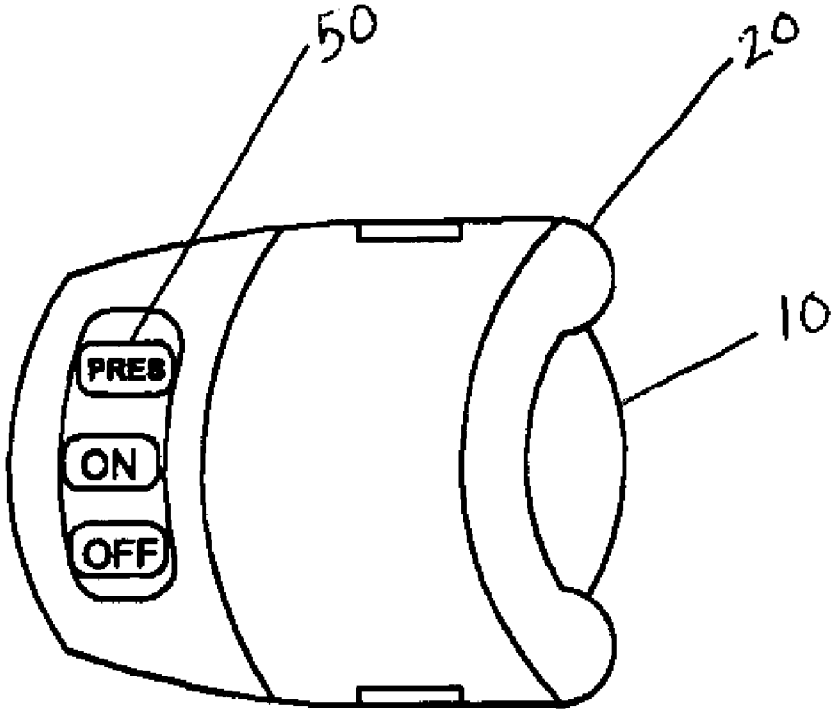
FIG. 1 shows a perspective view of an exemplary embodiment of a light source and a pressure sensor bypass means that may be used in a pressure activated lighted glove.

An exemplary embodiment of a pressure activated lighted glove 200 comprises a glove 100, a light source 10, a means for attaching 20 the light source to the glove, a power source 30 in electrical communication with the light source 10, a pressure sensor 40 attached to the glove 100 that is capable of detecting an applied force, and a pressure sensor bypass means 50. In a preferred exemplary embodiment the utilized glove 100 is both heat and water resistant. An example of such a glove 100 is the Fury Commando glove sold by BLACKHAWK PRODUCTS GROUP. This type of glove 100 is commonly referred to as a tactical glove. Tactical gloves are common and well-known to the art and there are numerous varieties of tactical gloves that could be used in practicing a pressure activated lighted glove 200. In some exemplary embodiments, the outer surface of the glove 100 has been treated with leather or another material to enhance the user's ability to get a grip while wearing the glove. Upon reading this disclosure, it would be clear to one skilled in the art that there are many glove and material variations that would work for the purposes of practicing the currently disclosed pressure activated lighted glove 200.

Figure 5:
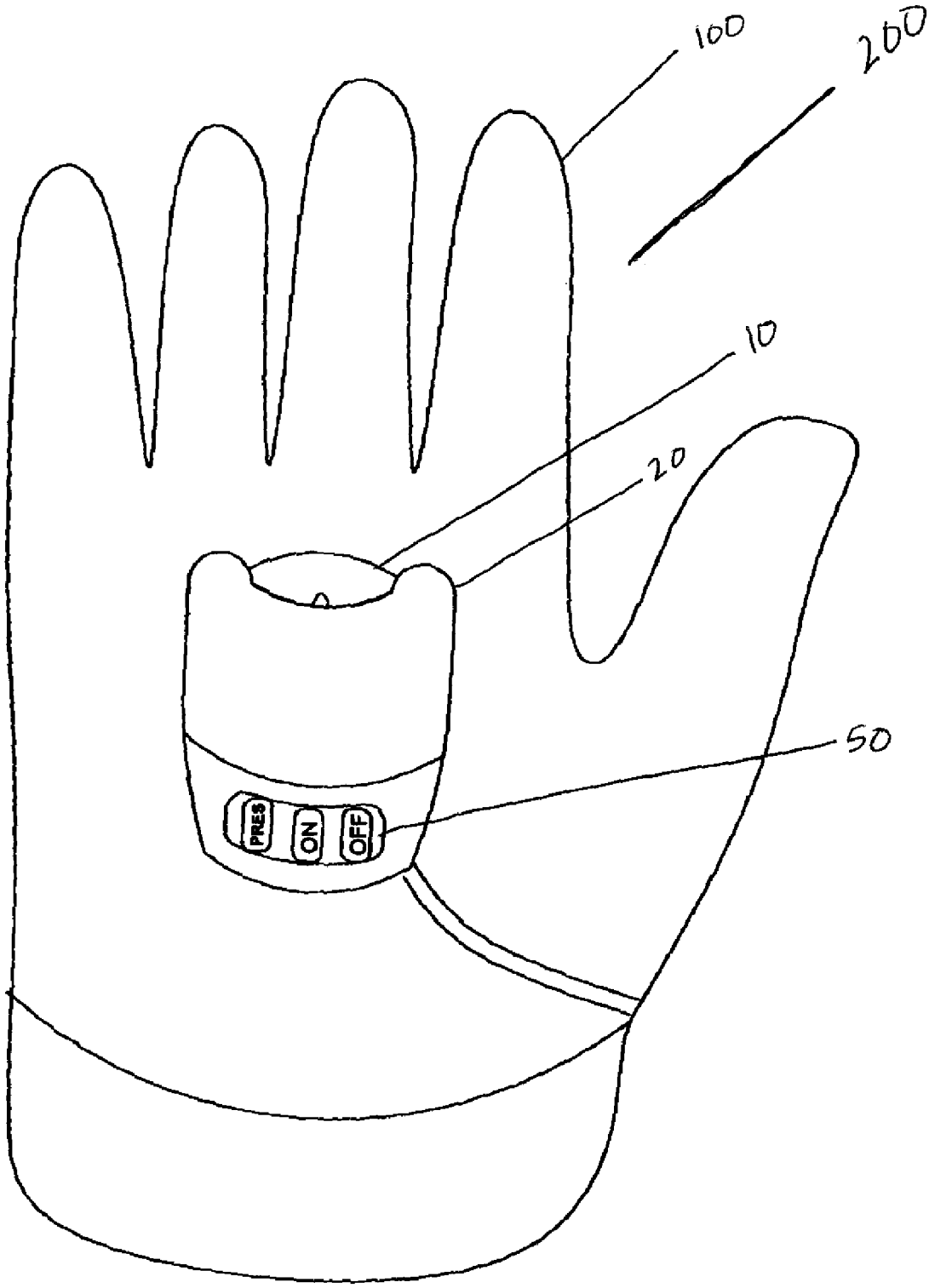
FIG. 5 shows a top plan view of an exemplary embodiment of a pressure activated lighted glove utilizing the exemplary light source of FIG. 1.

A pressure activated lighted glove 200 comprises a light source 10. FIGS. 1-4 each show an exemplary embodiment of a light source 10 that may be used in a pressure activated lighted glove 200. FIG. 5 shows an exemplary embodiment of how a light source 10 may be affixed to a glove 100 in order to form a pressure activated lighted glove 200. In a preferred exemplary embodiment, the light source 10 is a light-emitting diode ("LED") light source that emits white light under the application of an electric current. The light-emitting diode light source could emit white light by utilizing individual LEDs that emit three primary colors—red, green, and blue—and mixing all of the colors to produce white light. This method of producing white light is commonly referred to as multi-colored white LED. In another exemplary embodiment, phosphor material could be used to convert monochromatic light from a blue or ultra violet LED into broad spectrum white light (this is very similar to the way fluorescent bulbs work). In other exemplary embodiments, the light source 10 is an LED that emits a color of light other than white. The light source 10 may also be of a type other than a LED. For example, a traditional light bulb may be utilized. Some embodiments may utilize a light source 10 capable of putting out light of varying intensities.

In one exemplary embodiment, the light source 10 of a pressure activated lighted glove 200 is attached to the glove 100 by an attachment means 20. The attachment means 20 may be a casing capable of holding the light source in place. In a preferred embodiment, the attachment means 20 is a casing made of a polymeric material. FIG. 1, FIG. 2, FIG. 3, and FIG. 4 each show an exemplary embodiment of a light source 10 within an exemplary embodiment of a casing that has been made of a polymeric material. In some embodiments, a casing may be used to store the glove's light source 10, power source 30, and pressure sensor bypass means 50. In some exemplary embodiments the attachment means 20 is actually part of the glove's light source 10.

The attachment means 20 may be attached to a pressure activated lighted glove 200 in a variety of ways; for example a casing may be sewn to the glove 100 but it may also be attached to the glove 100 using an adhesive. In one exemplary embodiment, a casing acts as a docking for the glove's light source 10. Thus, the light source 10 can be placed into the docking and operated from the casing's location on the glove 100 but the light source 10 could also be utilized outside of the glove's docking. In some exemplary embodiments, the light source 10 could be removed from the casing that is attached to the glove 100 and attached to another part of the user's body but still be activated and deactivated using the pressure sensor located on the glove 100.

In one exemplary embodiment, a light source 10 that is removed from the attachment means 20 and positioned on another part of the user's body is capable of receiving signals from the glove 100. In a preferred embodiment, the received signals are generated from the glove's pressure sensor 40 upon detecting an applied force. The signal could be an electronic signal that is transmitted through an electrical wire that travels from the glove 100 to the light source 10, but could also be a signal such as a radio signal that is transmitted without a wire through the air that separates the glove 100 and the light source 10. Sending a signal through the air to activate a light source 10 is not new to the art. Such a system can be found in U.S. Pat. No. 3,971,028, U.S. Pat. No. 5,041,825, U.S. Pat. No. 5,192,126, U.S. Pat. No. 4,355,309 all of which are hereby incorporated by reference. In exemplary embodiments where the light source 10 can be removed from the attachment means 20 and still operated, it will be necessary for a power source 30 to remain in electrical communication with the light source 10. Thus, the light source 10 could be contained within a casing that is not the attachment means 20 where the casing also houses the power source.

In another exemplary embodiment, an attachment means 20 for a light source 10 is a band of fabric that holds the light source 10 in place. The attachment means 20 could also be an adhesive such as glue. In other exemplary embodiments the attachment means 20 is a wiring configuration that secures the light's location on the glove 100. There are numerous attachment means 20 capable of attaching the light source 10 to the glove 100 in order to form a pressure activated lighted glove 200.

Figure 2:
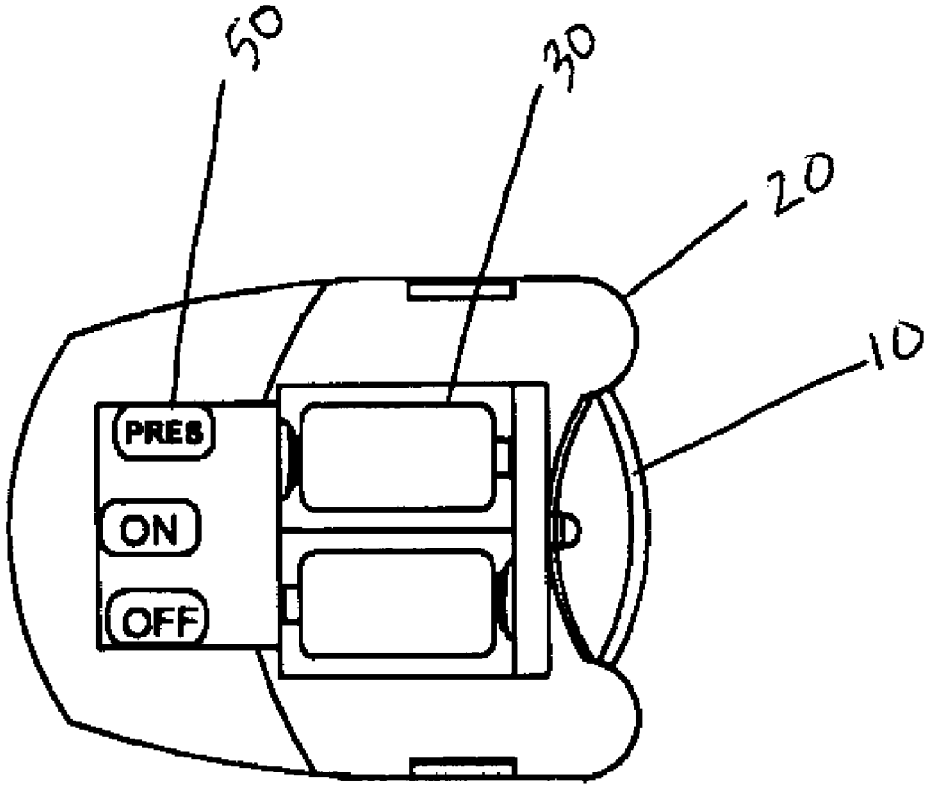
FIG. 2 shows a top plan view of the exemplary embodiment of FIG. 1 with part of the casing removed to show an exemplary embodiment of a power source.
Figure 3:
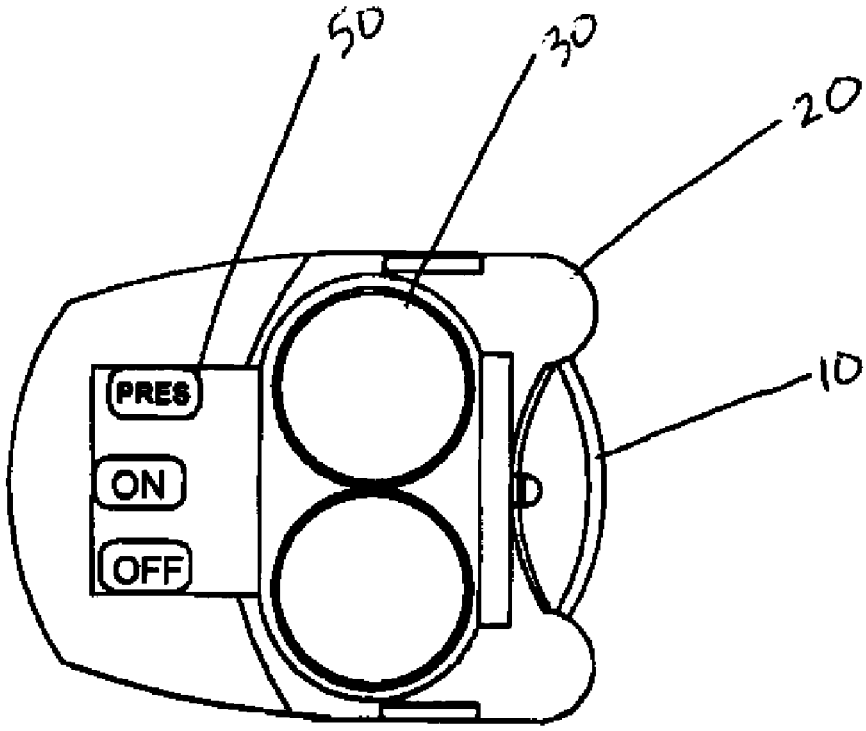
FIG. 3 shows a top plan view of the exemplary embodiment of FIG. 1 with part of the casing removed to show a second exemplary embodiment of a power source.
Figure 4:
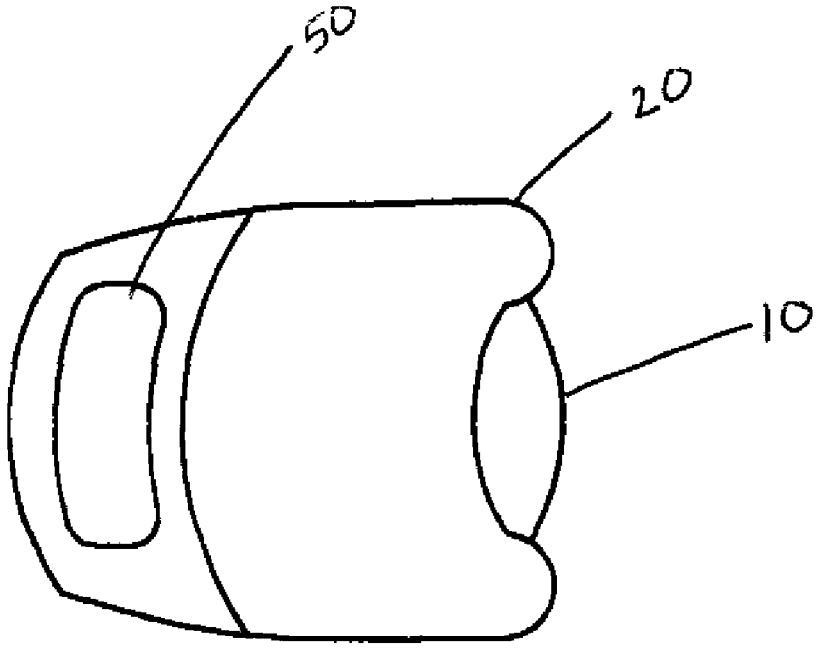
FIG. 4 shows a perspective view of a second exemplary embodiment of a light source that may be used in a pressure activated lighted glove.

The currently disclosed pressure activated lighted glove 200 comprises a power source 30. In some exemplary embodiments, such as is shown in FIG. 2, the power source 30 is batteries. The use of batteries to provide power to a light source 10 is well known in the art and is shown in U.S. Pat. No. 4,215,389, U.S. Pat. No. 4,398,237, U.S. Pat. No. 3,961,175, U.S. Pat. No. 4,977,489, and U.S. application Ser. No. 10/708,717 all of which are hereby incorporated by reference. In some exemplary embodiments, the power source 30 may be a rechargeable battery. The rechargeable battery may be rechargeable via a mechanism that plugs into a DC outlet. Rechargeable batteries are not new to the art. A typical rechargeable battery is disclosed by U.S. Pat. No. 4,996,128, U.S. Pat. No. 4,304,825, U.S. Pat. No. 5,919,589, U.S. Pat. No. 4,873,160, and U.S. Pat. No. 5,449,567 all hereby incorporated by reference. In other exemplary embodiments, the power source 30 may be recharged using energy from the sun. An example of a light source 10 powered by a battery that uses solar power to recharge is found in U.S. Pat. No. 6,290,367 which is hereby incorporated by reference. It is obvious to one skilled in the art upon reading this disclosure that many different types of power sources 30 could be used to make a pressure activated lighted glove 200.

Figure 6:
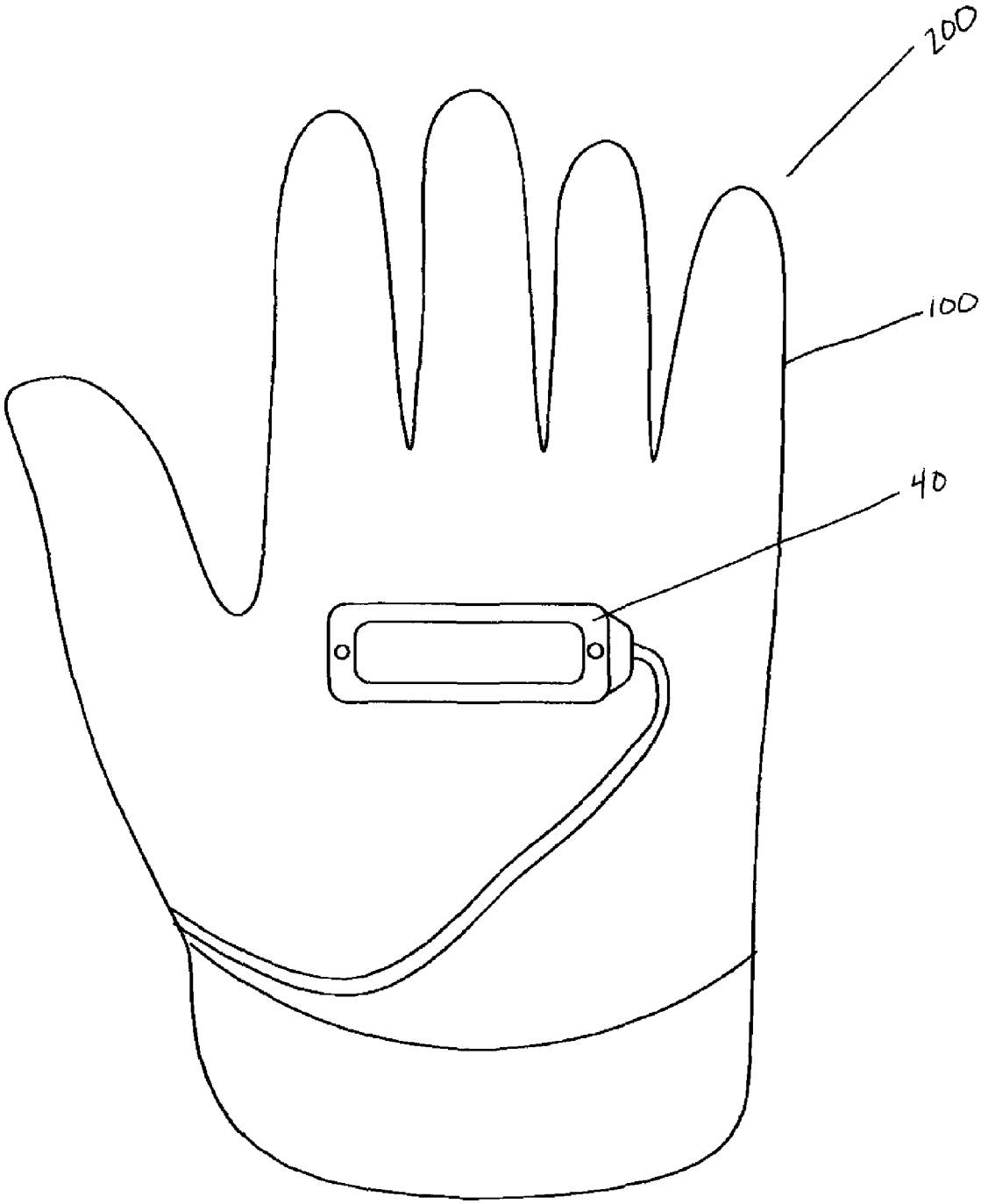
FIG. 6 shows a bottom plan view of the exemplary embodiment of FIG. 5 shown utilizing an exemplary embodiment of a pressure-activation pad.
Figure 7:
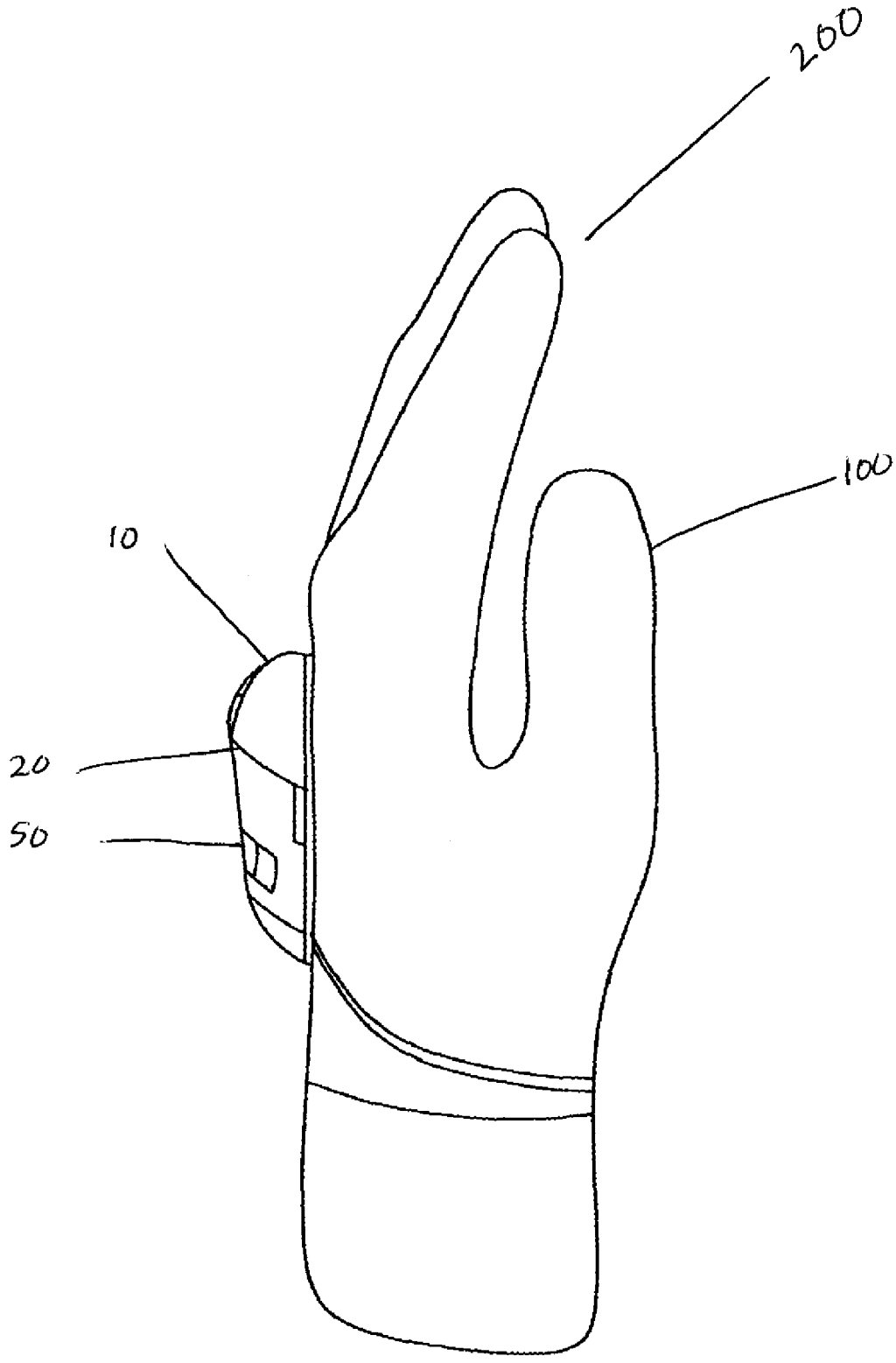
FIG. 7 is a side elevation view of the exemplary embodiment of FIG. 5.
Figure 8:
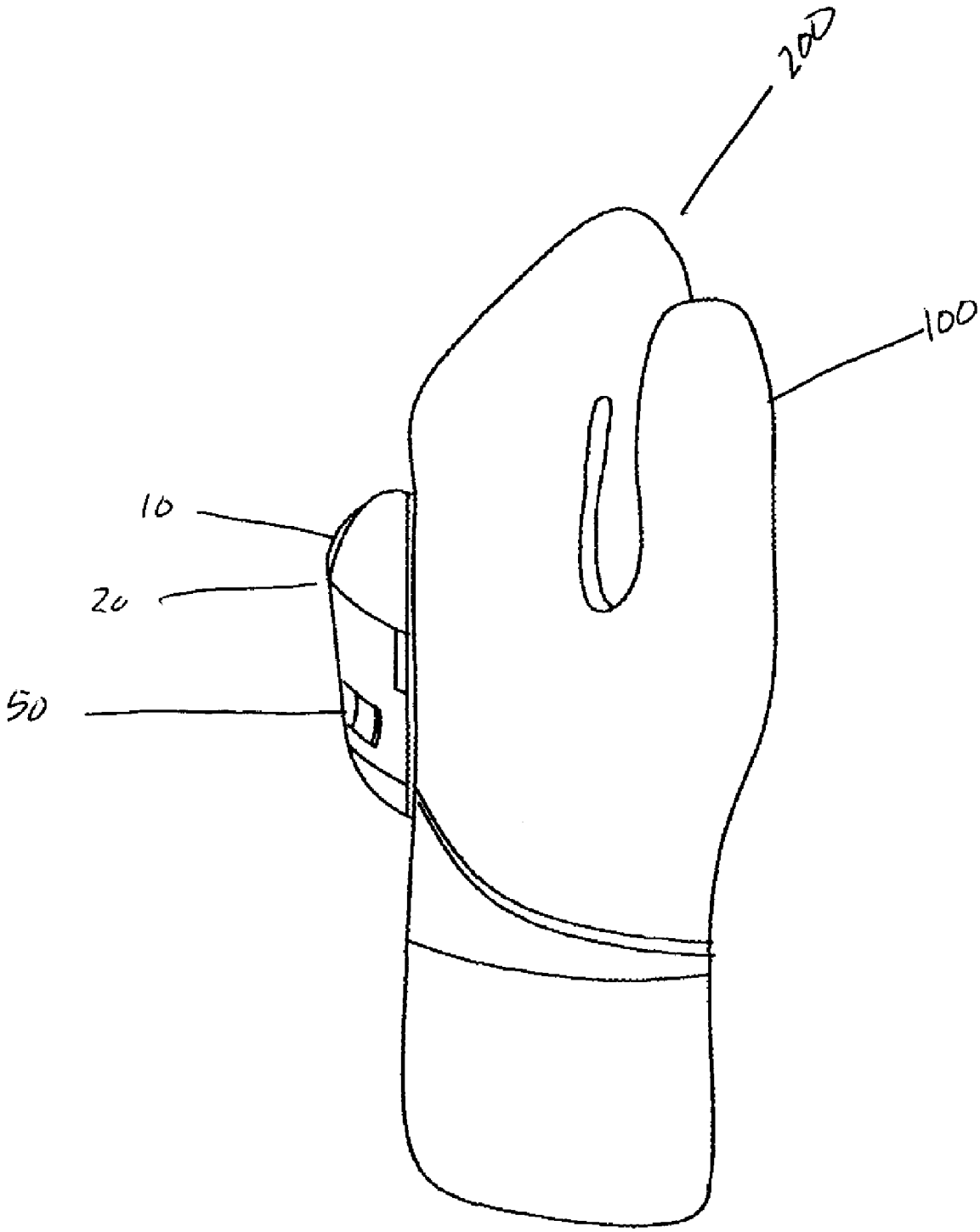
FIG. 8 is a side elevation view of the exemplary embodiment of FIG. 5 showing the glove in a closed-fisted position.
Figure 9:
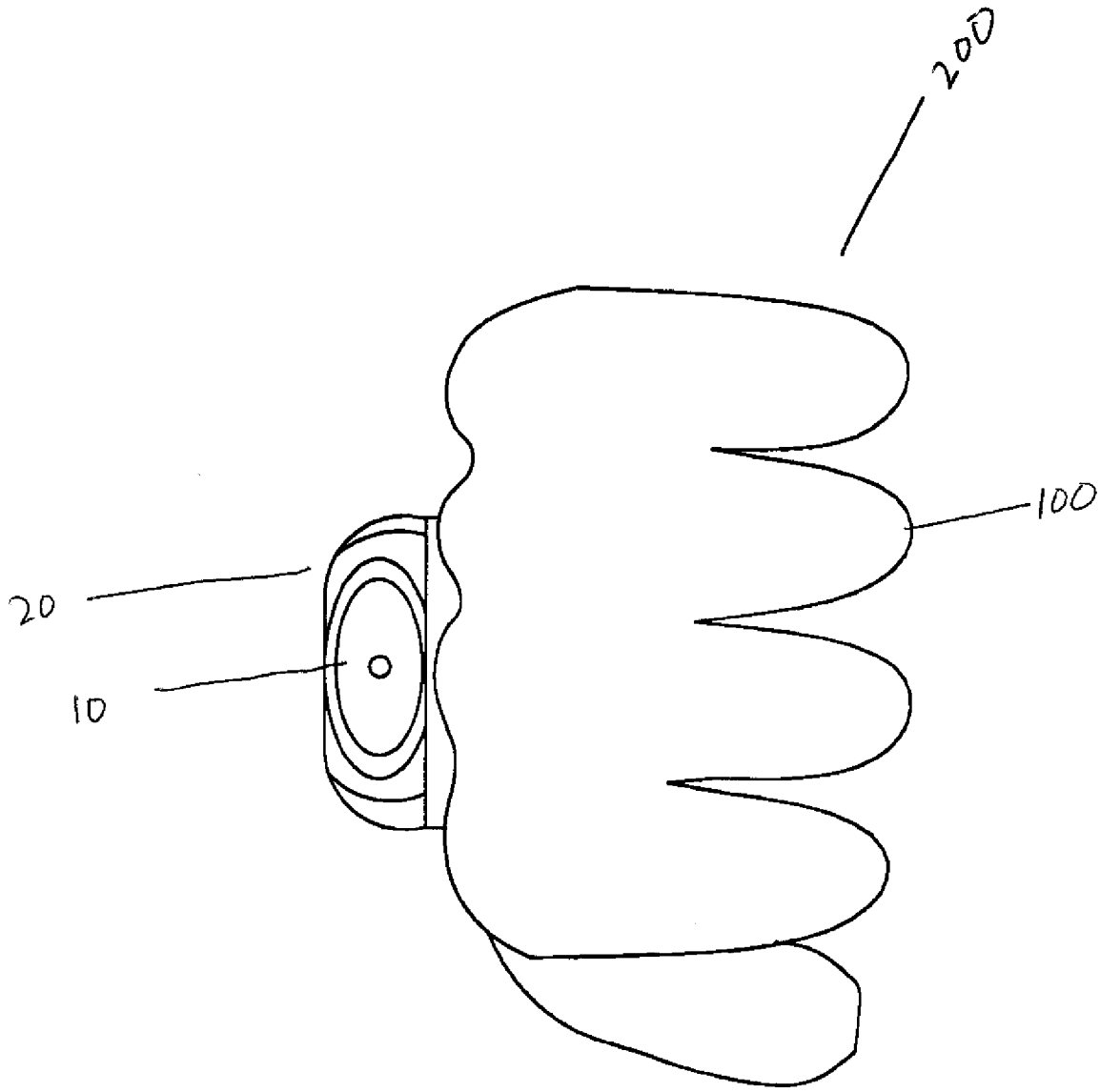
FIG. 9 is a front elevation view of the exemplary embodiment of FIG. 5 showing the glove in a closed-fisted position.

A pressure activated lighted glove 200 additionally comprises a pressure sensor 40. In a preferred exemplary embodiment, the pressure sensor 40 is a pad shaped device that is physically attached to the palm of the glove 100. FIG. 6 shows an exemplary embodiment of a pressure sensor 40 which has been affixed to the palm portion of a glove 100 in order to form a pressure-activated lighted glove 200. FIG. 7 and FIG. 8 each show an exemplary embodiment of a wire that may be utilized in forming a connection between the glove's pressure sensor 40 and light source 10. In some exemplary embodiments, the pressure sensor 40 is attached to the outer surface of the glove 100 while in other exemplary embodiments, the sensor 40 is encased by layers of the glove's fabric. In some embodiments, the sensor 40 is encased by waterproof material so that the sensor 40 is protected when the glove 100 is utilized in damp conditions. In some exemplary embodiments, the pressure sensor 40 of a pressure activated lighted glove 200 is located on one of the glove's fingers. In other exemplary embodiments a pressure sensor 40 can be located on any one of the glove's surfaces. Additionally, some exemplary embodiments may utilize more than one pressure sensor 40.

In some exemplary embodiments, a pressure sensor 40 located on the palm of the glove 100 enables a user to quickly turn on the glove's light source 10 without interrupting the user's involvement in another activity. For example, a user of the glove 100 who is riding a bike could be able to activate the glove's light source 10 by applying a force to the glove's pressure sensor 40 by pushing the palm of his hand firmly against the bike's handle bar. Likewise, a user of the glove 100 who is using his gloved hand to carry or utilize a device could activate the glove's light source 10 by applying a force to the glove's pressure sensor 40 by firmly squeezing the device being held in his hand.

In a preferred exemplary embodiment, a pressure activated lighted glove 200 comprises a pressure sensor 40 that is capable of detecting an applied force and upon detecting the force is capable of sending a signal to the power source 30. In some embodiments, the signal could cause the power source 30 to send power to the light source 10 causing the light source 10 to exude light, but it could also cause the power source 30 to discontinue sending power to the light source 10 such that the light is turned off. Thus, in an exemplary embodiment a user of a pressure activated lighted glove 200 could turn the glove's light source 10 on and then off by applying consecutive forces to the pressure sensor 40. The signal sent by the pressure sensor 40 could be electronic but it could also be of another type such as a radio signal. In some exemplary embodiments, the signal sent from the pressure sensor 40 causes the light source 10 to exude light until the pressure sensor 40 sends a second signal. In other embodiments, the signal sent from the pressure sensor 40 causes the light source 10 to be activated for a predetermined period of time.

In another exemplary embodiment a pressure sensor 40 is capable of differentiating between the strength of applied forces. Based on the strength of the force applied, the pressure sensor 40 causes a certain message to be sent to the power source 30. Based on the message received from the pressure sensor 40, the power source 30 may be able to send a certain amount of energy to the light source 10. In one exemplary embodiment, the greater the force detected by the pressure sensor 40, the greater the power sent from the power source 30 to the light source 10 and the greater the intensity of light put out by the light source 10. In another exemplary embodiment, a pressure sensor 40 is capable of detecting applied forces and sending a message to the power source 30 based on whether or not the detected force falls within a certain range. For example, a pressure sensor 40 might be able to detect an applied force and determine that the force is not great enough to fall within the predetermined range required to send a signal to the power source 30.

A pressure activated lighted glove 200 further comprises a pressure sensor bypass means 50. In a preferred embodiment, the pressure sensor bypass means 50 enables the effective deactivation of the pressure sensor's 40 ability to turn the light source 10 on and off. In a preferred embodiment, the pressure sensor bypass means 50 comprises a three way switch connected to or housed within the attachment means 20. FIGS. 1, 2, 3, and 5 each show an exemplary embodiment of a pressure sensor bypass means 50 comprising a three way switch. The pressure sensor bypass means 50 could also be located on the glove 100 or on the light source 10. In a preferred embodiment, the pressure sensor bypass means 50 is a three way switch that has the following three settings: pressure activation, light on, and light off. When the switch is set to "pressure activation", the pressure sensor 40 can be used to turn the glove's light on and off. When the switch is set to "light on" the glove's light is activated independently of the pressure sensor 40. When the switch is set to "light off" the glove's light is deactivated and the only way to turn it on is to turn the switch to one of its other two settings. In some exemplary embodiments the pressure activated glove 200 has a pressure sensor bypass means 50 that is a switch with more or less than three settings. In other exemplary embodiments, the pressure sensor bypass means 50 comprises a plurality of buttons while in other embodiments the pressure sensor bypass means 50 is only a single button.

The exemplary embodiments herein disclosed are not intended to be exhaustive or to unnecessarily limit the scope of the invention. The exemplary embodiments disclosed were chosen and described in order to explain the principles of the invention so that others skilled in the art may practice the invention. Having shown and described exemplary embodiments of the invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A lighted glove comprising:
- a glove;
- a light source attached to said glove;
- a power source in electrical communication with the light source;
- a pressure sensor attached to the glove for activating and deactivating said light source; and
- a pressure sensor bypass means for disabling said pressure sensor's ability to activate and deactivate said light source where the pressure sensor bypass means comprises a three way switch.

2. The lighted glove of claim 1 wherein said glove is a tactical glove.

3. The lighted glove of claim 1 wherein said pressure sensor comprises a pad-shaped device located on the palm of said glove.

4. The lighted glove of claim 1 wherein said light source is attached to said glove by a casing which provides for the docking of the light source onto said glove.

5. The lighted glove of claim 4 wherein the light source comprises a light bulb capable of emitting varying levels of light based on the amount of power received from the power source.

6. The lighted glove of claim 1 where said light source comprises:
- a light emitting diode; and
- a casing surrounding said diode.

7. The lighted glove of claim 1 further comprising:
- a radio signal transmitter in communication with said pressure sensor; and
- a radio signal receiver in communication with said power source.

8. The lighted glove of claim 1 further comprising:
- an electrical wire connecting said pressure sensor to said power source.

9. A lighted glove comprising:
- a glove;
- a light source;
- a casing that houses the light source and is attached to said glove;
- a power source in electrical communication with the light source;

a pressure sensor attached to the glove;

an electrical wire connecting said power source to said pressure sensor; and a means for temporarily disabling the pressure sensor where the disabling means comprises a three way switch.

10. The lighted glove of claim 9 where the power source comprises:

a battery; and housing for said battery.

11. The lighted glove of claim 9 where the disabling means comprises a three way switch.

12. The lighted glove of claim 9 where the power source comprises a solar cell.

13. The lighted glove of claim 9 where the power source is rechargeable.

14. A lighted glove comprising:

a glove;

a first layer of fabric; and a second layer of fabric;

a light source;

a means for connecting the light source to the glove;

a power source in electrical communication with the light source;

a first pressure sensor for activating and deactivating said light source;

an electrical wire that extends from the first pressure sensor to the power source;

a second pressure sensor for activating and deactivating said light source;

an electrical wire extending from the second pressure sensor to the power source; and a pressure sensor bypass means for disabling the pressure sensors' ability to activate and deactivate said light source.

15. The glove of claim 14 where said light source comprises:

a red light emitting diode;

a blue light emitting diode; and a green light emitting diode.

16. The glove of claim 14 further comprising a means for recharging the power source.

17. The glove of claim 14 where said glove comprises a first layer of fabric and a second layer of fabric.

18. The glove of claim 17 wherein the first and second pressure sensors are located between the first and second layers of fabric.

19. The glove of claim 14 where the pressure sensor bypass means comprises a three way switch.

20. The glove of claim 14 where the light source comprises a light bulb capable of emitting various levels of light based on the amount of power received from the power source.

21. The glove of claim 17 where said electrical wires are housed entirely between the glove's first layer of fabric and second layer of fabric.

22. A lighted glove comprising:

a glove;

a light source attached to said glove by a casing which provides for the docking of the light source onto said glove;

a power source in electrical communication with the light source;

a pressure sensor attached to the glove for activating and deactivating said light source; and a pressure sensor bypass means for disabling said pressure sensor's ability to activate and deactivate said light source;

wherein the light source comprises a light bulb capable of emitting varying levels of light based on the amount of power received from the power source.

23. A lighted glove comprising:

a glove;

a light source attached to said glove;

a power source in electrical communication with the light source;

a pressure sensor attached to the glove for activating and deactivating said light source;

a pressure sensor bypass means for disabling said pressure sensor's ability to activate and deactivate said light source;

a radio signal transmitter in communication with said pressure sensor; and a radio signal receiver in communication with said power source.

24. A lighted glove comprising:

a glove;

a light source;

a casing that houses the light source and is attached to said glove;

a power source in electrical communication with the light source where said power source comprises a solar cell;

a pressure sensor attached to the glove;

an electrical wire connecting said power source to said pressure sensor; and a means for temporarily disabling the pressure sensor.

* * * * *

UNITED STATES PATENT AND TRADEMARK OFFICE

CERTIFICATE OF CORRECTION

PATENT NO. : 7,819,544 B2
APPLICATION NO. : 12/360580
DATED : October 26, 2010
INVENTOR(S) : Justin Thompson and Timothy L. Matheney, II It is certified that error appears in the above-identified patent and that said Letters Patent is hereby corrected as shown below:

In claim 14 lines 19-20, delete
"a first layer of fabric; and
a second layer of fabric;"

Signed and Sealed this

Fourteenth Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,819,544 B2
APPLICATION NO. : 12/360580
DATED : October 26, 2010
INVENTOR(S) : Justin Thompson and Timothy L. Matheney, II It is certified that error appears in the above-identified patent and that said Letters Patent is hereby corrected as shown below:

In claim 14 Column 7, lines 19-20, delete
"a first layer of fabric; and
a second layer of fabric;"

This certificate supersedes the Certificate of Correction issued December 14, 2010.

Signed and Sealed this
Fourth Day of January, 2011

David J. Kappos

David J. Kappos
*Director of the United States Patent and Trademark Office*